United States Patent [19]

Miller

[11] Patent Number: 4,556,176

[45] Date of Patent: Dec. 3, 1985

[54] ROVING WINDER CONTROLLER

[75] Inventor: Gary M. Miller, Jackson, Tenn.

[73] Assignee: Owens-Corning Fiberglas Corporation, Toledo, Ohio

[21] Appl. No.: 680,383

[22] Filed: Dec. 11, 1984

[51] Int. Cl.[4] ..... B65H 63/02; B65H 54/02

[52] U.S. Cl. ..... 242/38; 242/18 G; 242/42

[58] Field of Search ..... 242/42, 38, 37 R, 36, 242/18 G, 49

[56] References Cited

U.S. PATENT DOCUMENTS

| | | | |
|---|---|---|---|
| 3,966,132 | 6/1976 | Gelin et al. | 242/36 |
| 4,010,908 | 3/1977 | Patterson | 242/36 |
| 4,074,871 | 2/1978 | Stotler | 242/42 |
| 4,143,506 | 3/1979 | Pierce et al. | 57/22 |
| 4,233,520 | 11/1980 | Canfield | 250/561 |
| 4,275,297 | 6/1981 | Canfield et al. | 250/239 |
| 4,344,582 | 8/1982 | Rapp et al. | 242/45 |

*Primary Examiner*—Stanley N. Gilreath

*Attorney, Agent, or Firm*—Ronald C. Hudgens; Greg Dziegielewski; Ronald E. Champion

[57] ABSTRACT

Method and apparatus for controlling a roving winder compares the number of strands of material actually being wound to a number of strands which should be wound into a roving. The controller stops the winding process if the two numbers are not equal. The use of a microprocessor allows not only the comparison but also generation of a control signal and a means to communicate the process information to a host computer.

2 Claims, 9 Drawing Figures

ROVING WINDER CONTROLLER

TECHNICAL FIELD

The present invention disclosed herein provides a method and apparatus for controlling the gathering of a set number of individual strands of filamentary material together into a roving and collecting this roving on a winder.

BACKGROUND OF THE INVENTION

Textile operations often require simultaneous handling of many continuous linear elements, such as yarns or strands. An example of one such operation is the production of rovings by winding together multiple strands of fibrous material such as glass fibers. The quality of the roving is dependent upon winding together a set number of strands to produce a particular roving product.

It has been a practice to produce a composite roving by withdrawing strands of glass fibers from packages held in creels and converging them into a group or roving and winding the roving onto a rotatable packaging tube, collet or collector. It has been found that one of the major problems in producing such a composite linear roving product lies in maintaining a set number of strands being wound into the roving package.

This problem was recognized by Patterson, U.S. Pat. No. 4,010,908, wherein he used discrete logic devices, specifically, NAND gates and a decoder to produce a control signal which would stop the winding process if the number of strands being wound falls below an acceptable level. Patterson, although an advancement at its time, does not allow communication of any information to supervisory digital computers which control other processes or log the history on products being produced. Changing to another roving product requiring a different number of strands also proved difficult using the apparatus disclosed by Patterson.

Rapp and Zolnerovich, U.S. Pat. No. 4,344,582, recognizing the shortcomings of Patterson, developed a microprocessor-based system for controlling the entire roving process. The system described by Rapp et al included strand detection, automatic strand insertion, winder motor speed control, motor acceleration control, mandrel or collet control and included in memory a library of product codes with number of strands to be wound for a given product. The Rapp et al system is an excellent system, but it is expensive to build and install. What is needed is a low cost microprocessor system which has the limited control features of Patterson but which can also communicate information to a supervisory host computer which is currently controlling other functions such as strand insertion, motor speed, motor acceleration and doff controls.

SUMMARY OF THE INVENTION

One of the embodiments of the present invention is an apparatus which converts a plurality of signals from a plurality of strand detectors into a first digital signal. A series of switches on the controller allows the operator to set the number of strands which should be wound together into a roving. The signals from panel switches are converted into a second digital signal by the controller. The controller receives a signal from the winder to indicate if the winder is running. If the winder is running, then the controller compares the first digital signal to the second digital signal. If these two digital signals are not equal, then the winder is stopped and an alarm is activated. The controller also provides a communication bus so that a host computer can poll the controller to collect the number of strands being counted, the number of strands which should be wound and whether the winder is collecting roving.

A second embodiment of the present invention is a method of controlling a roving winder. The number of strands of filamentary material being wound together into a roving is converted into a first digital signal. The number of strands which should be wound together into a roving is set into the controller. This number is converted into a second digital signal. The first digital signal is compared to the second digital signal. If the signals are not equal, then the winder is stopped. An alarm is sounded if the controller stops the winder. The status of the process is also communicated to a host computer.

DESCRIPTION OF THE PREFERRED EMBODIMENT

Figure 1:
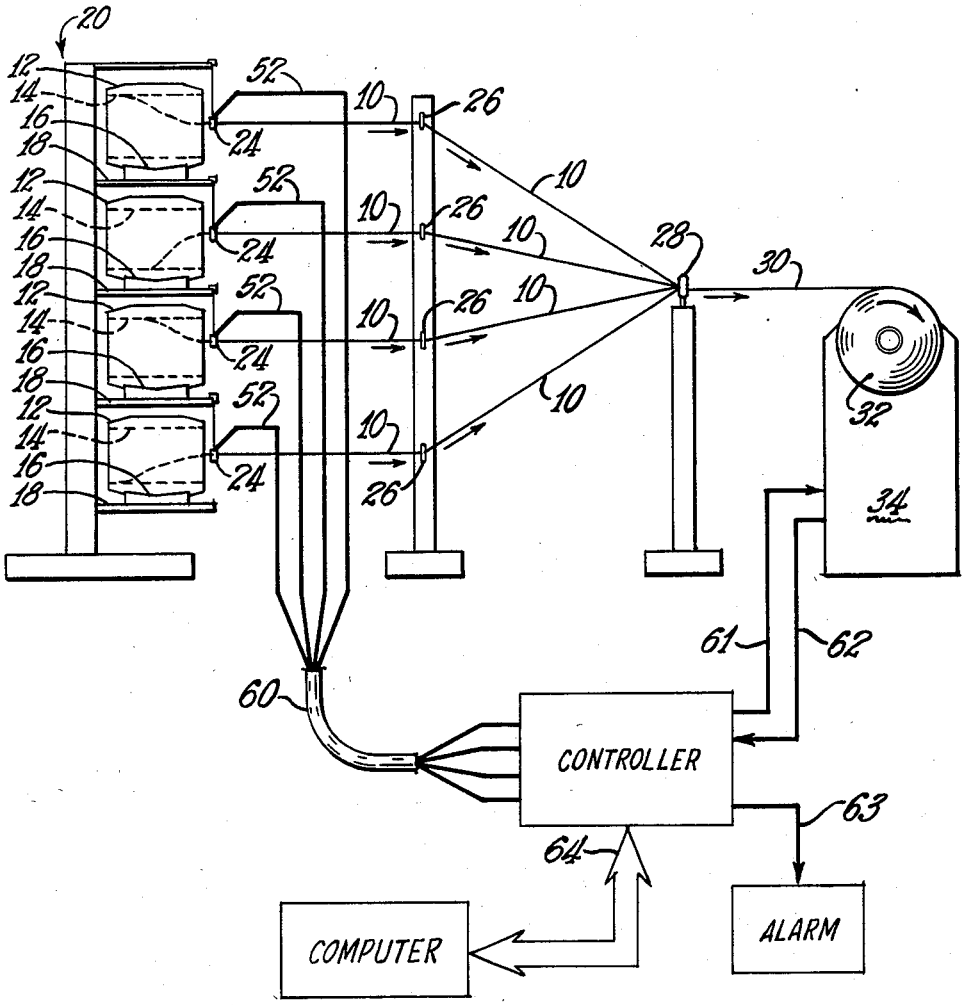
FIG. 1 is a side view illustrating a typical high speed creel and winder assembly utilizing the roving winder controller of the present invention.

FIG. 1 illustrates a high speed creel and winder assembly usable with the present invention to control a conventional package roving process. Individual strands of filamentary material 10, such as glass fibers, are withdrawn from the inside 14 of a package 12. The package is supported in a creel holder 16 attached to a support 18 which is attached to the creel frame 20. The support also holds a strand detector 24 through which the strand passes. The strands progress through strand guides 26 to a strand collector 28 where it is gathered into a roving 30. The roving progresses in the direction of the arrow and is wound on a collet 32. The collet is driven by a winder 34.

Each individual strand detector outputs a signal on line 52 indicating that a strand is moving through the detector. The signal lines 52 are bundled together into a cable 60 and led to the controller. FIG. 1 shows four creel positions for ease of illustration only. Any number of strands may be counted as will be explained later. The controller also receives a signal on line 62 from winder 34 which indicates that the winder is winding a roving. A signal goes from the controller to the winder on signal line 61 to stop the winder if the controller signals such action. An alarm signal also goes from the controller to an alarm on signal line 63. The controller can communicate with a computer on a communication bus 64.

Figure 2:
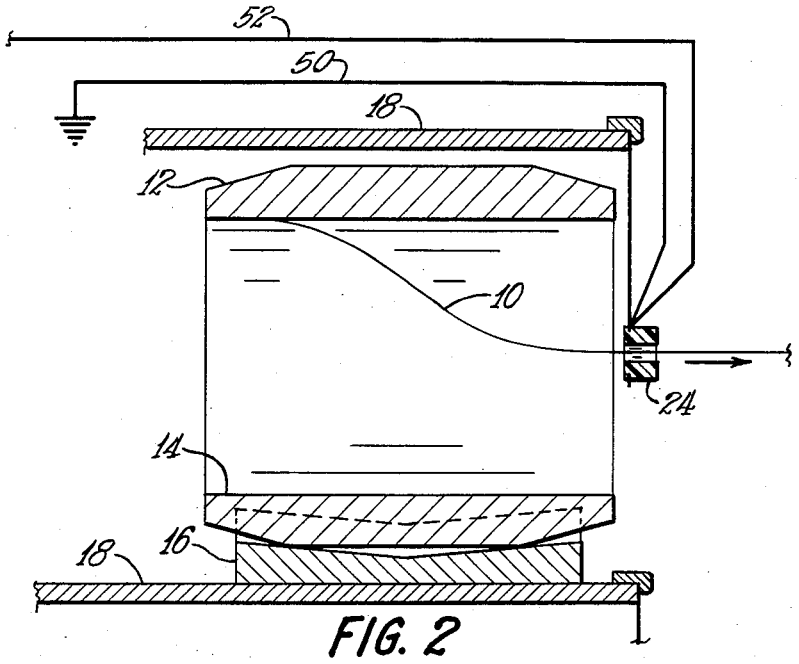
FIG. 2 is a sectional side view of a strand package and the strand detector.

FIG. 2 is a large scale cross section of the package 12. The strand 10 is withdrawn from the center 14 of the package 12. The package rests on a creel holder 16 supported by support 18. A strand detector 24 is also supported by the support. The strand detector may be of any of the detectors known in the art which produces a signal when a strand is passing through the detector. A specific detector useful in practicing the present invention is described by Canfield U.S. Pat. No. 4,233,520. This detector uses a light source which impinges the strand. A light detector measures the light reflected from the strand. One of the signal lines 50 is grounded while the other signal line 52 transmits the signal to the controller. The signal produced by the detector and impressed upon signal line 52 is typically a 2 volt peak to peak random waveform varying from about 10 hertz to 100 hertz, with a DC offset of about 16 to 20 volts.

Figure 3:
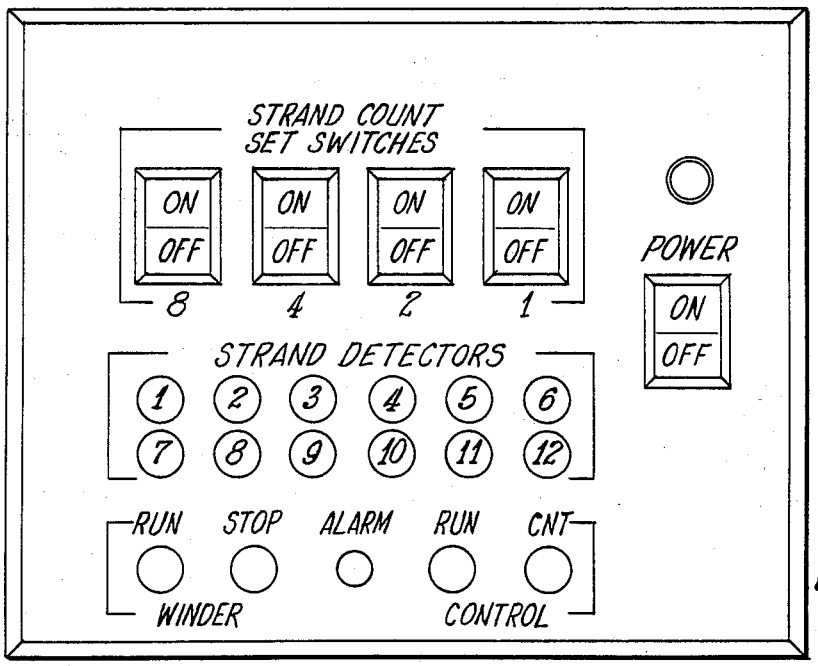
FIG. 3 is a front view of the face panel of the roving winder controller.

FIG. 3 shows the front panel of the controller. An on/off power switch and an indicator lamp is provided for power to the controller. A series of switches are provided for setting the number of strands to be collected. These switches can be simple on/off type and are used to set the number of strands in binary code. Four switches are shown for illustration purposes only, and additional switches may be added for additional strands. To set the number of strands to eleven, the eight switch would be on, the two switch would be on and the one switch would be on. This would give a count of eleven, i.e., $8+2+1=11$. If additional switches were added, the next switch would represent the number sixteen, the next thirty two etc., in binary progression. Twelve strand detector light emitting diodes are represented. These LED's are lit if a strand is being detected by the strand detector. Additional LED's may, of course, be added if additional strands are to be wound. Five status lights are provided. Two are for the winder. One indicates that the winder is running, and one indicates that the winder has stopped. Two lamps are provided for the controller, one for running and one for counting. An alarm lamp is provided.

Figure 4:
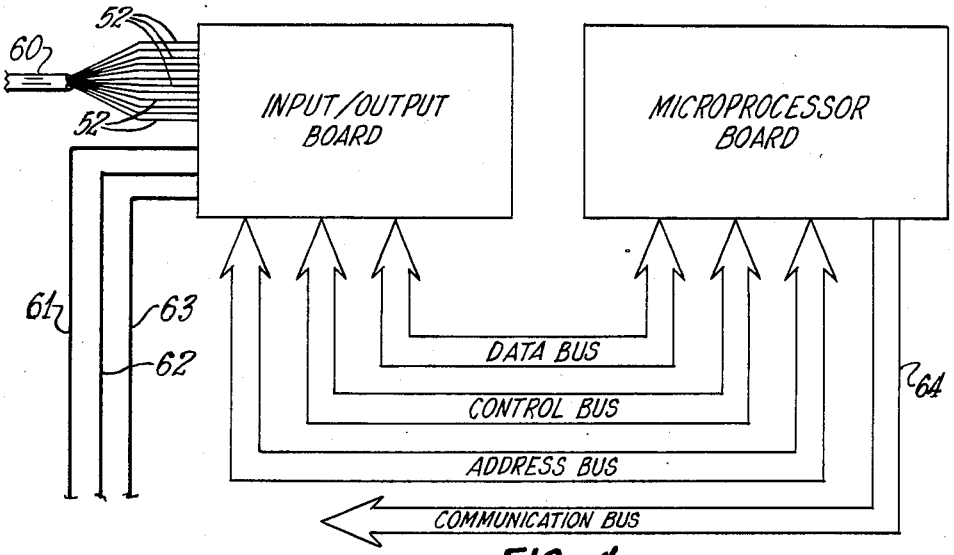
FIG. 4 is a block diagram of the roving winder controller of the present invention.

FIG. 4 shows a block diagram of the controller. Two major boards make up the controller. An input/output board and a microprocessor board is provided. The bundled signal lines 60 are fed to the input/output where the individual strand detector signal lines 52 are attached to the board. The signal line 62 from the winder is also attached to the input/output board. The input/output board outputs the stop signal to the winder on line 61 and to the alarm on line 63. The input/output board communicates to the microprocessor board by means of a data bus, an address bus and a control bus. The microprocessor board also provides a communication bus 64 for communication to a host computer.

Figure 5:
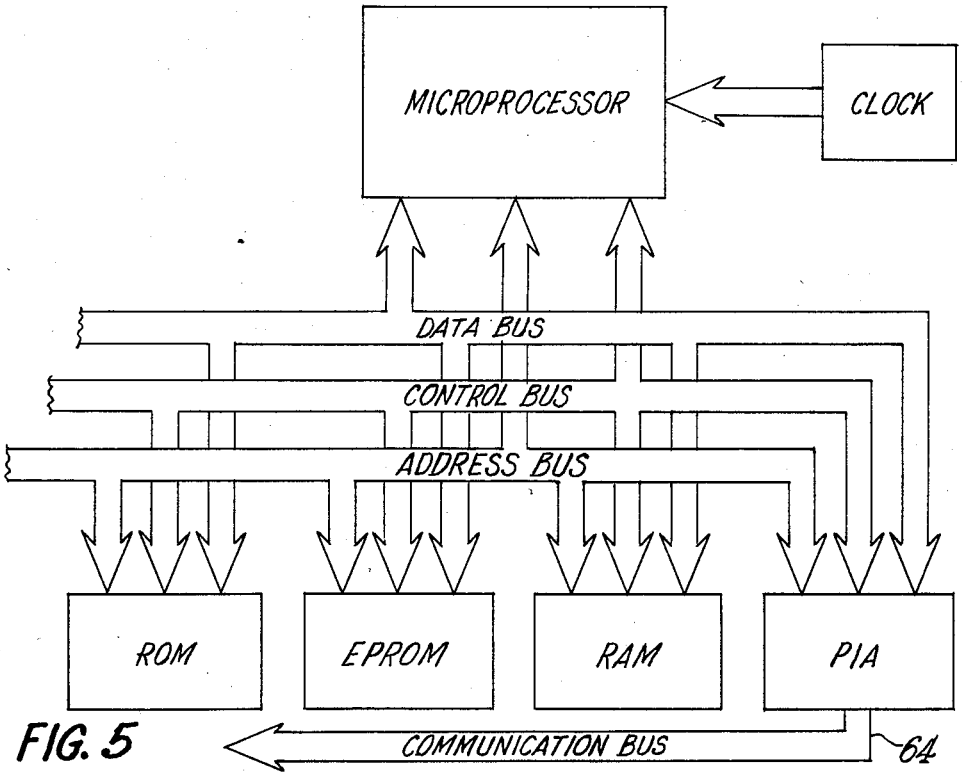
FIG. 5 is a block diagram of the microprocessor board used in the roving winder controller.

FIG. 5 shows a block diagram of the microprocessor board. A clock provides timing signals to the microprocessor. The microprocessor used in the present invention is a Motorola MC6809E; however any microprocessor may be used as known in the art. The microprocessor has associated with it and interconnected through a data bus, an address bus and a control bus memory circuitry of the ROM, read only memory, EPROM, electrical programmable read only memory and RAM random access memory type. A PIA, peripheral interface adapter, is provided to produce a communication bus 64 to a host computer. If necessary, an ACIA or asychronous communication interface adapter may be provided to produce a serial communication port for printer or modem as is well known in the art.

Figure 6:
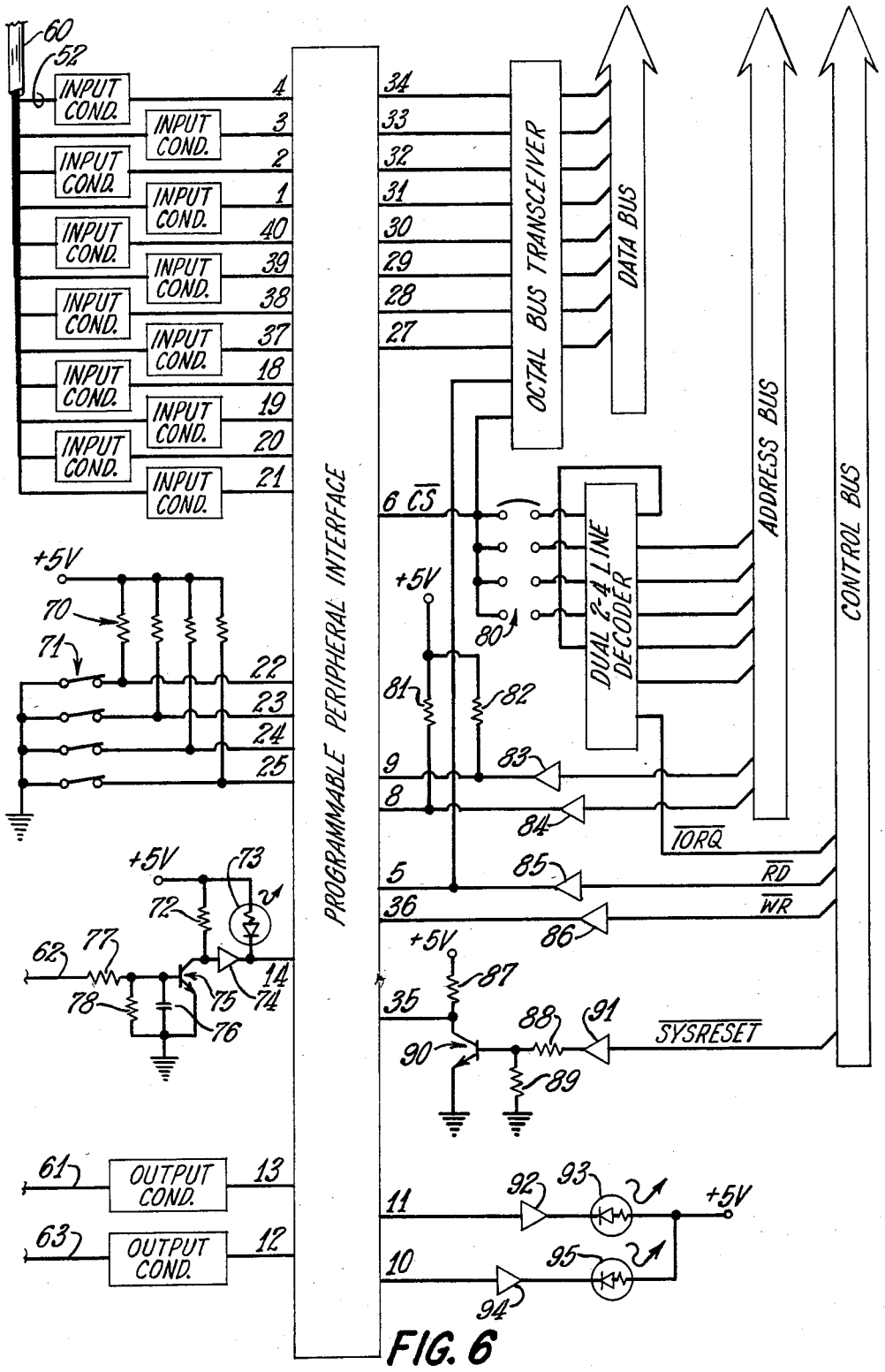
FIG. 6 is a schematic diagram of the input/output board of the roving winder controller.

FIG. 6 is a schematic diagram of the input/output board. A programmable peripheral interface chip is provided. This chip may be any of several known in the industry. The chip used by the present invention is produced by Intel and known as a P8255A programmable peripheral interface chip. The pin numbers of the chip have been shown in FIG. 6 for completeness. Note that no power supply connections have been shown except where needed for explanation as the power supply connections to the various chips are well known in the art.

The bundle of signal wires 60 from the strand detector are led to the input/output board. The individual signal lines 52 are fed through individual input conditioners to the programmable peripheral interface chip. The input conditioner circuit will be explained later. A series of on/off switches 71 as shown in FIG. 3 are connected to the peripheral interface chip. A series of pull up resistors 70 having a typical value of 4.7 Kohms are connected to a +5 volt source. When the switch is off, a +5 volts is impressed upon the chip. When the switch is on, the +5 volts is routed to ground and the chip detects a ground. The low signal or ground signal is interpreted by the chip as a valid signal.

The run signal from the winder is inputted on signal line 62 as a +24 volt DC signal. This is dropped across resistor 77 which is typically a 22 Kohm resistor and fed to the base of transistor 75 which is part of a CA308IN seven transistor array with common emitters. The emitter is attached to ground. An RC circuit consisting of resistor 78, a 4.7 Kohm resistor and capacitor 76, a 0.1 microfarad capacitor is also connected to the base of the transistor to smooth out spurious fluctuations. The collector of transistor 75 is connected through a pull up resistor 72, a 4.7 Kohm resistor, to buffer 74, one element of a 74LS244N octal buffer. This buffer drives light emitting diode 73 by providing a low signal to the programmable peripheral interface chip when signal line 62 is high.

Two output signal lines are provided by the programmable peripheral interface chip. Each of these lines go through an individual output conditioner and go to signal line 61 and 62 as will be explained later. Two status indicator lines are provided. The first is fed through buffer 94, which is one part of a 7407 open collector hex non-inverting buffer to light emitting diode 95. The diode is the lamp indicated in FIG. 3 as control run. The second status indicator line is fed through buffer 92, again one portion of a 7407 buffer to light emitting diode 93. This LED is indicated in FIG. 3 as control count.

Various control lines are fed to and from the programmable peripheral interface off the control bus. A system reset line designated SYSRESET comes from the control bus through buffer 91, one part of a 74LS244N octal buffer to a voltage divider consisting of resistor 88, and resistor 89, both 4.7 Kohm resistors to the base of transistor 90, one part of a CA3081N, seven transistor array. The emitter of the transistor is grounded, and the collector goes through a 4.7 Kohm pull up resistor 87 to a positive five volts. When the SYSRESET line is activated, the pin 35 of the programmable peripheral interface chip goes high, and the system resets. A read RD line is fed to the programmable peripheral interface chip through buffer 85. A write WR line is similarly fed to the chip through buffer 86. The read line RD is also fed to an octal bus transceiver and, when activated, causes the transceiver to place its data on the data bus. The octal bus transceiver outputs an eight bit digital signal. The four most significant bits are the second digital signal which is the number inputted by the switch array.

The four least significant bits make up the first digital signal represented by the number of strands being detected by the strand detector.

Since the P8255A chip is a programmable peripheral interface chip, two control lines come from the control bus to program the chip's ports as input and/or output ports. The first of these lines go through buffer 83 to pull up resistor 82 to plus five volts. The second port select line goes through buffer 84 and pull up resistor 81 to plus five volts.

The description given so far has handled up to twelve strand detector lines. More input/output board may be used as is known in the art to increase the number of strands being monitored. To accomplish this, a dual 2-4 line decoder is used. The decoder receives its signals from the address bus. The output of the decoder goes to jumper panel 80. The output from the jumper panel goes to the CS line of the programmer peripheral interface chip. If the input/output board is monitoring strands 1-12, then the upper contacts of the jumper panel are connected. If this is the second input/output board and strands 13-24 are being monitored, then the second set of jumpers are connected, the third set of contacts are for the third input board which monitors strands 25-36. Similarly, the last, or fourth board is indicated by connecting the fourth set of contacts and monitors strands 37-48.

Figure 7:
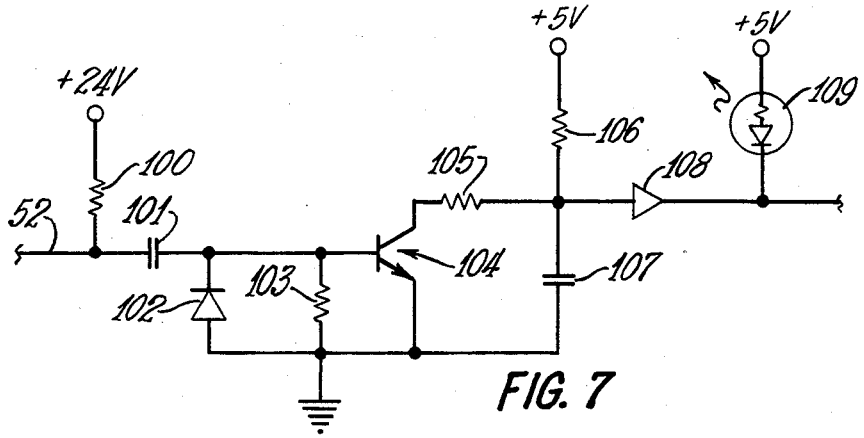
FIG. 7 is a circuit diagram of the input conditioner of the input/output board used in the roving winder controller.

FIG. 7 is the input conditioner for the signals from the strand detector. A signal comes in line 52 from the strand detector. The signal is approximately a 2 volt peak to peak random waveform varying from about 10 hertz to 100 hertz, with a DC offset of about 16 to 20 volts. Sufficient current is provided to drive the circuit by a 24 volt source across resistor 100, a 22 Kohm resistor. Capacitor 101, a 4.7 micro-farad capacitor couples the AC signal but blocks the DC component of the signal. Diode 102, a 1N914 device, effectively clamps all negative signals to −0.6 volts and resistor 103, a 100 Kohm resistor, references the signal at the base of transistor 104 to ground. Whenever a signal then goes above 0.6 volts, the transistor is turned on and capacitor 107 is discharged through resistor 105. Capacitor 107 will start to charge through resistor 106 whenever transistor 104 is turned off. The detector signal must continually pulse the transistor on to keep the capacitor 107 from changing above the threshhold of the buffer 108, a 74LS244 device, which would indicate that the strand is broken. The buffer simply isolates the RC circuit and drives light emitting diode 109 and the programmable peripheral interface chip.

Figure 8:
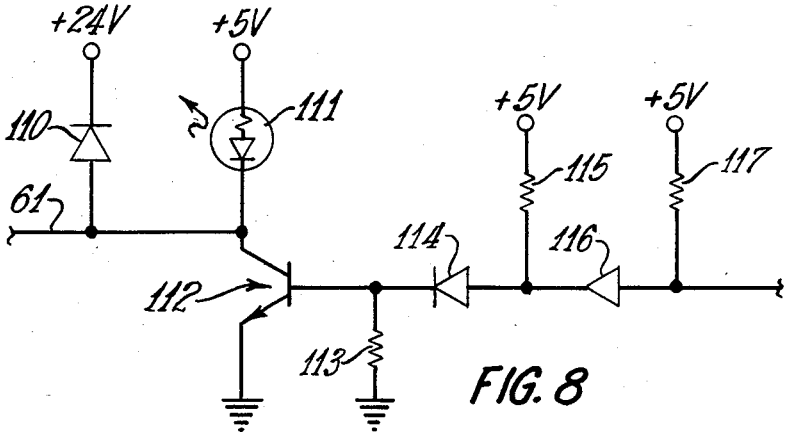
FIG. 8 is a circuit diagram of the output conditioner of the input/output board used in the roving winder controller.

FIG. 8 shows the schematic of the output conditioners. The signals come from the programmable peripheral interface chip and drive the open collector buffer 116. Resistor 117 connected to +5 volt biases the buffer high when no signal is present. Similarly, resistor 115 biases the output of the buffer 116 high when it is not conducting. A blocking diode 114 prohibits feedback into the buffer. Transistor 112, a 2N4921 device, has the signal line connected to its base. The emitter is grounded, and the collector is the output signal and is connected to light emitting diode 111 to indicate that the winder is to stop or the alarm is activated. A diode 110, a 1N914 device, is connected to a +24 volt source as the driving power for the signal line.

Figure 9:
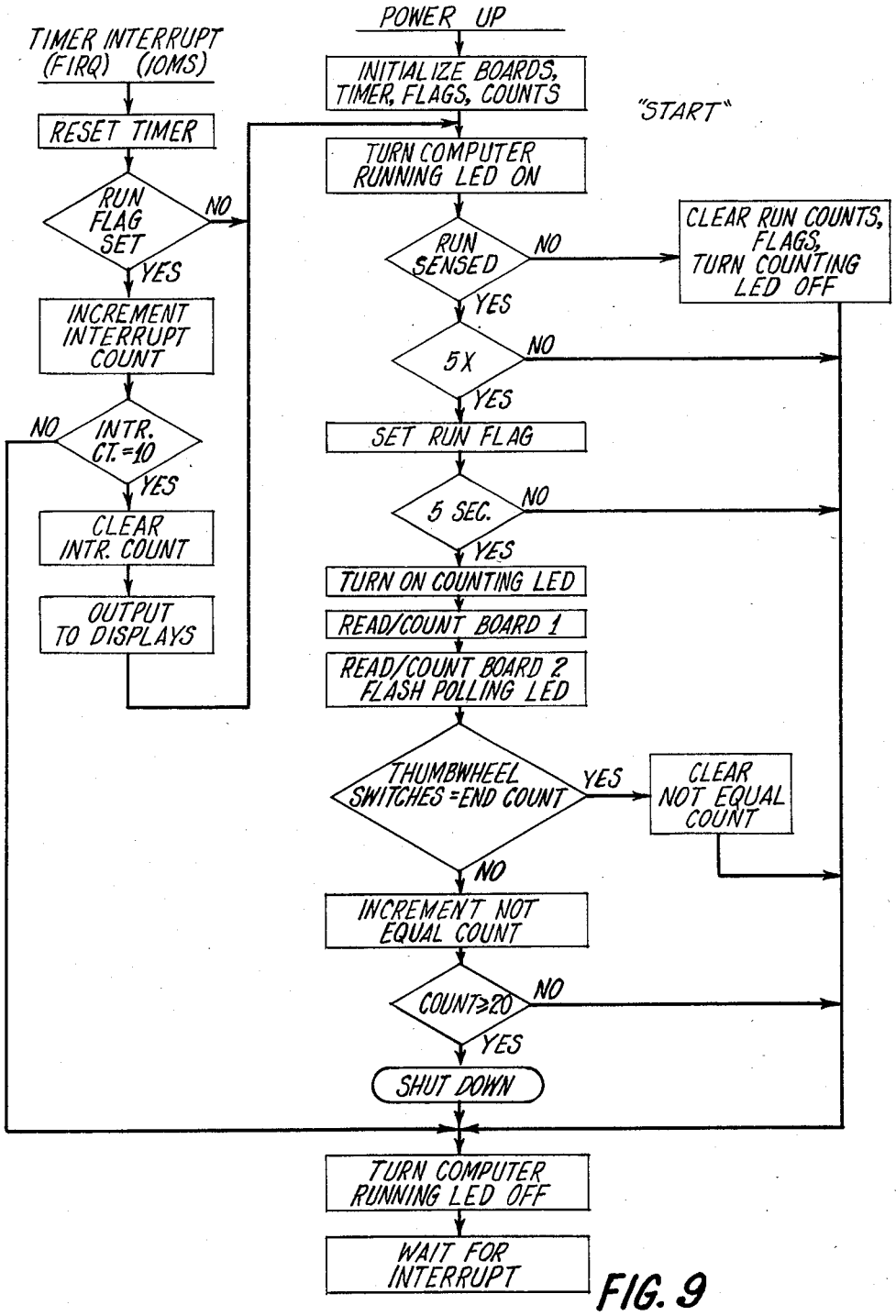
FIG. 9 is a flow diagram of the program used to control the microprocessor used in the roving winder controller.

FIG. 9 is a block diagram of the program used to control the microprocessor in the present invention. The program compares the number of strands being wound to the number set on the switches on the front panel. If the numbers are not equal, the winder is stopped.

With this detailed description of this specific apparatus used to illustrate the preferral embodiment of the present invention and the operation thereof, it will be obvious to those skilled in the art that various modifications can be made in both the method and apparatus of the present invention without departing from the spirit and scope of the invention which is limited only by the appended claims.

INDUSTRIAL APPLICABILITY

The foregoing invention allows a specific number of strands of filamentary material to be gathered together into a roving. The method and apparatus prevents the roving from being wound if the actual number of strands being wound is different than the number of strands which should be wound. The use of a microprocessor for control allows communication of process information to a host computer.

I claim:

1. A controller for a roving winder comprising:

(a) a microprocessor for receiving input information, for processing said information, for producing a control signal in response to said input information and for communicating said input information and said output signal to a computer;

(b) a means to convert a plurality of signals from a plurality of strand detectors into input information as a first digital signal which can be processed by said microprocessor;

(c) a means to manually input a number as a second digital signal which can be processed by said microprocessor, said second digital signal being representative of the number of strands to be wound together into a roving by the winder;

(d) a program means for controlling said microprocessor, said program designed to compare by means of the microprocessor said first digital signal to said second digital signal and instruct said microprocessor to output a control signal if said first digital signal does not equal said second digital signal;

(e) an output means to convert said control signal into a means to stop said winder and for activating an alarm; and (f) a means to communicate said first digital signal, said second digital signal and said control signal to a computer.

2. A method for controlling a roving winder comprising the steps of:

(a) converting a plurality of signals from a plurality of strand detectors into a first digital signal;

(b) inputting a number representative of the number of strands to be wound into a roving by the winder;

(c) converting said number into a second digital signal;

(d) comparing said first digital signal to said second digital signal by means of a microprocessor;

(e) producing a control signal if said first digital signal does not equal said second digital signal;

(f) outputting said control signal to the winder to stop the winder; and (g) transmitting said first digital signal, said second digital signal and said control signal to a computer.

* * * * *